US008099894B1

(12) United States Patent
Philbin

(10) Patent No.: US 8,099,894 B1
(45) Date of Patent: Jan. 24, 2012

(54) RETRIEVAL SOCK ATTACHABLE TO AN ASSOCIATED RETAINING PLATE AND FLOOR PLATE OF AN AMMUNITION MAGAZINE

(75) Inventor: Kevin Philbin, Glenview, IL (US)

(73) Assignee: Elite Research, LLC, Dexter, MI (US)

( * ) Notice: Subject to any disclaimer, the term of this patent is extended or adjusted under 35 U.S.C. 154(b) by 387 days.

(21) Appl. No.: 12/361,856

(22) Filed: Jan. 29, 2009

Related U.S. Application Data

(60) Provisional application No. 61/024,437, filed on Jan. 29, 2008.

(51) Int. Cl.
*F41A 9/61* (2006.01)

(52) U.S. Cl. ..... 42/50; 42/90; 42/106; 42/49.01; 224/196

(58) Field of Classification Search ..... 42/18, 22, 42/49.01, 50, 85, 90, 106; 224/191, 196, 224/198, 674; 206/3, 317
See application file for complete search history.

(56) References Cited

U.S. PATENT DOCUMENTS

| | | | | |
|---|---|---|---|---|
| 2,205,967 | A * | 6/1940 | Wise | 42/49.01 |
| 5,682,981 | A * | 11/1997 | Sudborough | 206/38.1 |
| 5,740,905 | A * | 4/1998 | Kilfoy | 206/87 |
| 6,212,815 | B1 | 4/2001 | Fitzpatrick | |
| 6,481,136 | B1 | 11/2002 | Fitzpartick | |
| 6,536,152 | B1 * | 3/2003 | Wisz | 42/71.01 |
| 6,634,131 | B1 | 10/2003 | Fitzpatrick | |
| 6,698,129 | B1 * | 3/2004 | Hanks | 42/90 |
| 6,748,689 | B2 | 6/2004 | Fitzpatrick | |
| 6,883,261 | B2 | 4/2005 | Fitzpatrick | |
| 7,174,666 | B2 | 2/2007 | Fitzpatrick | |
| 7,207,131 | B2 | 4/2007 | Fitzpatrick | |
| 7,921,587 | B2 * | 4/2011 | Mayberry | 42/6 |
| 2003/0046850 | A1 * | 3/2003 | Beretta | 42/50 |
| 2004/0031829 | A1 * | 2/2004 | Guimond et al. | 224/196 |

* cited by examiner

*Primary Examiner* — Gabriel Klein
(74) *Attorney, Agent, or Firm* — Gifford, Krass, Sprinkle, Anderson & Citkowski, P.C.

(57) ABSTRACT

A sock secured to an exposed end of an ammunition holding magazine associated with a projectile firing device. The sock includes a heavy duty and frictionally engaging curtain shaped body, such as constructed of a heavy duty silicone. An integrally formed lanyard loop extends from the body, this enabling easy single finger engagement for accomplishing easy and efficient withdrawal of the magazine from a projectile firing device, easy storage and ease of transport.

9 Claims, 3 Drawing Sheets

RETRIEVAL SOCK ATTACHABLE TO AN ASSOCIATED RETAINING PLATE AND FLOOR PLATE OF AN AMMUNITION MAGAZINE

CROSS-REFERENCE TO RELATED APPLICATIONS

This Application is a Non-Prov of Prov (35 USC 119(e)) application 61/024,437 filed on Jan. 29, 2008 and entitled Retrieval Sock Attachable To An Associated Retaining Plate And Floor Plate Of An Ammunition Magazine.

FIELD OF THE INVENTION

The present invention discloses a magazine withdrawal/retrieval sock secured to an exposed end of the magazine, and which is further an improvement over prior art tape and tie solutions for enabling easy engagement and withdrawal of the magazine from such as an automatic/semi-automatic rifle or machine gun.

BACKGROUND OF THE INVENTION

The prior art is well documented with examples of extraction grip or retrieval devices. The purposes of such devices include their use and application for facilitating the removal of an ammunition holding magazine, such as which is secured to a projectile firing device.

A first example is shown in U.S. Pat. Nos. 6,748,689 and 6,883,261, both to Fitzpatrick, and which discloses integral extensions for aiding in the extraction of ammunition magazines from ammunition pouches. The sides of the ammunition magazine are extended, either by molding or affixing a handle directly to the sides of the magazine, to thereby provide a grasping handle.

Other examples include U.S. Pat. Nos. 6,634,131 and 6,212,815, also to Fitzpatrick, and which describes another type of magazine extraction grip including a sleeve of resilient material molded in the general shape of a magazine, however exhibiting a smaller inner circumference than that associated with the magazine to require the band to be stretched over the magazine. The top of the band exhibits a smaller inner circumference than the lower part of the band and extending from the top is a handle for permitting a users finger to wrap there-around to extract the magazine.

Yet further examples of integral magazine extraction extensions are shown in U.S. Pat. Nos. 7,207,131, 7,174,666 and 6,481,136, also to Fitzpatrick. A handle is permanently attached to an existing or modified floor plate of a magazine. In one example, a substitute floor plate is provided with a molded projecting handle. In another, a handle with a grip and a terminal end is provided with an attachment structure thereupon. Existing floor plates can also modified by cutting anchoring holes to allow for attachment of the handles, and without hindering use in an ammunition magazine or molded with the anchoring holes.

SUMMARY OF THE INVENTION

The present invention discloses a magazine withdrawal/retrieval sock secured to an exposed end of the magazine and which is further an improvement over the above-described prior art magazine retrieval devices, as well as prior art tape and tie solutions for enabling easy engagement and withdrawal of the magazine from such as an automatic/semi-automatic rifle or machine gun. The sock is constructed of a heavy duty and frictionally engaging silicone and, according to one variant, is initially stored/shipped and applied in an inverted position to an open end of the magazine, this further such that a projecting portion of the inverted sock seats within a central recess associated with a magazine retaining plate, and in turn is seated within the open magazine end.

A floor plate is secured in slidable fashion over the retaining plate and through an opening in the inverted sock. The sock is then rolled upward and over the end region of the magazine and provides an environmentally resistant covering. A durable, typically likewise silicone, finger engageable loop portion is integrally formed with the unrolled end of the sock and enables easy single finger draw or disengagement of the magazine from the associated weapon, as well as easy storage and/or transport options.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
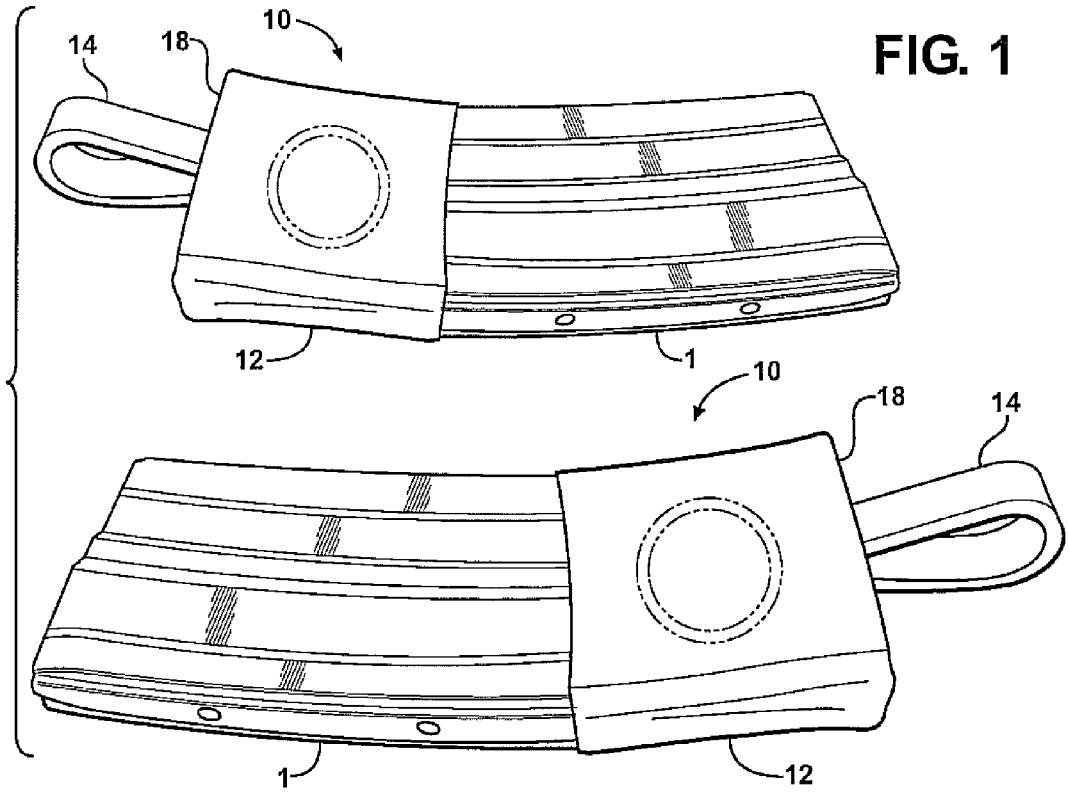
FIG. 1 illustrates a pair of magazines, each exhibiting a retrieval sock in an affixed and use position.

Referring now to FIG. 1, an illustration is shown of a pair of magazines 1, each of which exhibits a retrieval sock further generally referenced at 10, in an affixed and use position according to the present invention. As will be described in additional detail in reference to the succeeding illustrations, the present invention discloses a sock 10 constructed of a heavy duty material, such as in one embodiment a frictional silicone material including a curtain shaped body 12, and from one end of which extends in integral fashion a looped lanyard portion 14.

The curtain shaped body 12 is illustrated exhibiting a plurality of interconnected sides exhibiting a generally rectangular cross sectional and extending shape, this revealing an outer open end defining an open and three dimensional extending interior which generally corresponds to a lower most extending portion of the magazine 1. The present invention further contemplates a flexible body exhibiting any desired shape, material consistence or dimensioning which is necessary for engaging over an extending end portion of any conventional sized magazine beyond and in addition to that illustrated herein. As further shown in each of the magazines illustrated in FIG. 1, the sock 10 is secured to an exposed end of the magazine 1 as an improvement over prior art tape and tie solutions for enabling easy engagement and withdrawal of the magazine 1 from such as an automatic/semi-automatic rifle or machine gun (not shown).

Figure 2:
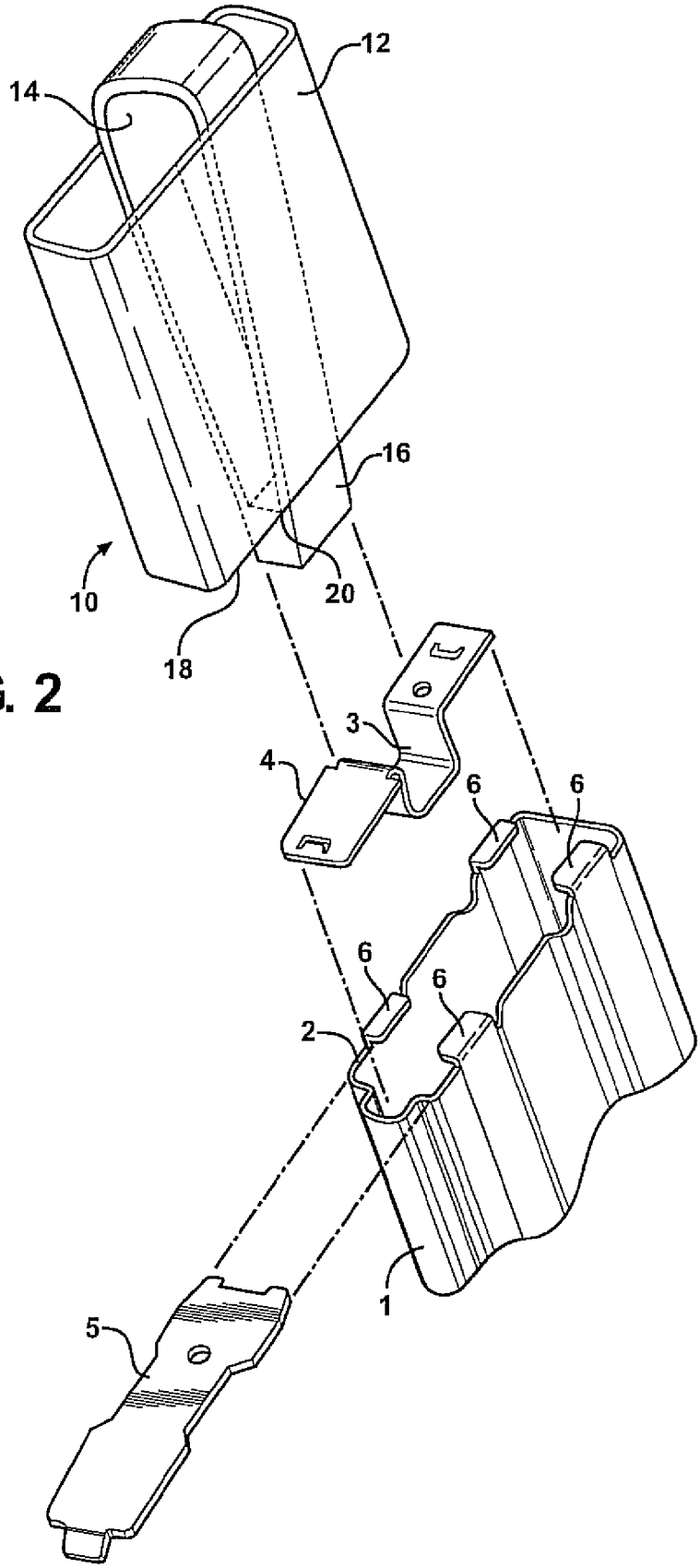
FIG. 2 is an exploded and installation view of the retrieval sock to an ammunition magazine.

Referring now to FIG. 2, an exploded and installation view is shown of the retrieval sock 10 to the ammunition magazine 1. As shown, the sock 10 is initially stored/shipped and applied in an inverted position (and with the integrally secured lanyard loop 14 turned inside out within the curtain 12) to an open end 2 of the magazine 1.

As is also illustrated in FIG. 2, a projecting portion 16 of the inverted sock 10 constitutes such as a solid piece of silicone material integrally formed with and extending from an opposite (eventually interior) side of an associated base surface 18, this defining a closed inner end of the body 12 relative to the lanyard loop 14 and overlaying an corresponding end face of the magazine (see floor plate 5 described below). The projecting portion 16 provides an additional degree of reinforcing support to the lanyard loop connection to the base 18 and remaining sides of the curtain 12. As further best shown in phantom in FIG. 2, a laterally directed opening 20 is defined within the projecting portion 16, and such that projecting portion is spaced a distance from the base 18 in a direction opposite to that of the extending lanyard loop 14.

The projecting base portion 16 seats within a central recess 3 associated with an existing magazine retaining plate 4, and which is in turn seated within an open end of the magazine 2. As further shown in FIG. 2, the magazine again includes floor plate 5 which is slidable over the open end 2 of the magazine 1, specifically engaging underneath pairs of inwardly turned tabs 6.

In this fashion, the floor plate 5 is engaged over the open end of the magazine 1, and in order to fixedly secure the inverted sock 10 by extending through the laterally extending opening 20 in the inverted sock and sandwiching the projecting portion 16 between the floor plate 5 and the underneath positioned retaining plate 4. The sock 10 is then rolled upward and over the end region of the magazine 1 and functions both to establish a resistive engagement of the sock 10 to the magazine 1 (this preventing inadvertent peel-off of the sock such as through a rapid inertial pulling force exerted on the lanyard loop overcoming whatever additional frictional holding forces are exerted between the inner facing surfaces of the curtain body and the exterior sides of the magazine) as well as to provide an environmentally resistant covering at the connection junction established between the floor plate 5 and the open end 2 of the magazine. The lanyard loop 14 is dimensioned to enable easy single finger (or multiple finger) draw or disengagement of the magazine 10 from the associated weapon, as well as providing for easy storage (such as suspending) and/or transport options.

Figure 3:
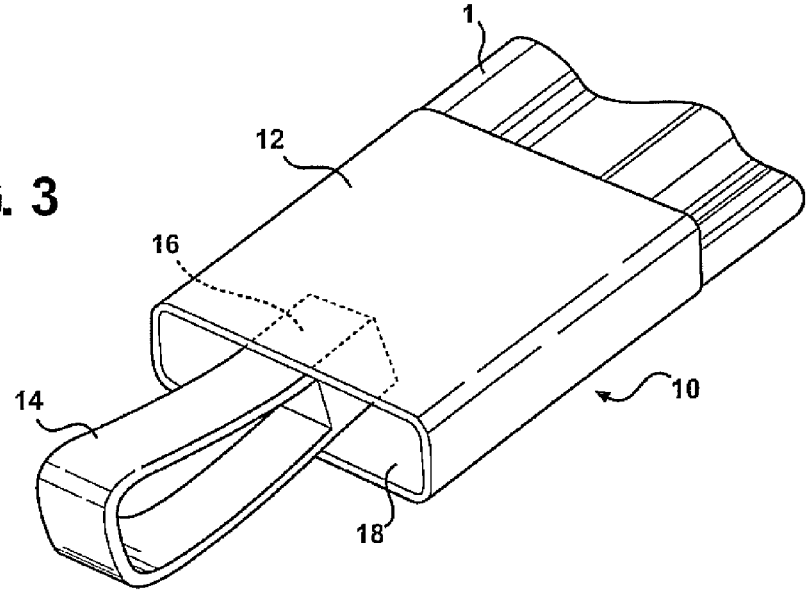
FIG. 3 is a successive illustration of the magazine sock in an installed position and illustrating in phantom the interiorly positioned and projecting portion secured via the floor plate and retaining plate to the extending magazine end.

FIG. 3 is a successive illustration of the magazine sock 10 in an installed position (similar to that shown in FIG. 1) and illustrating in phantom the interiorly positioned and projecting portion secured via the floor plate and retaining plate to the extending magazine end. As previously indicated, the arrangement of the projecting portion 16 is such that it provides seating engagement of the sock base 18 to the end of the magazine 1. Alternate embodiments also envision sizing the dimensions of the sock and its curtain such that they can frictionally and resistively engage the exterior profile of the magazine without the requirement of any additional engaging structure between the sock and the magazine.

Figure 4:
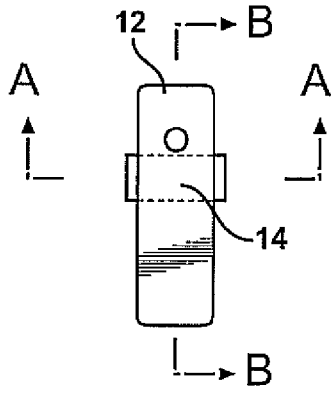
FIG. 4 is a top diagrammatic view of the magazine retrieval sock and illustrating from one vantage point the arrangement of the lanyard/loop relative to the extending curtain body.
Figure 5:
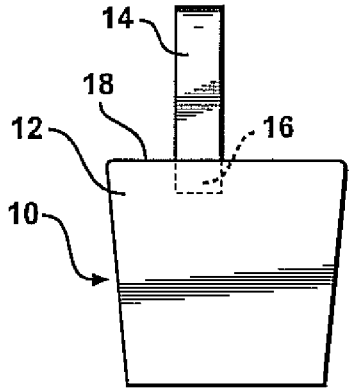
FIG. 5 is a succeeding side view showing the arrangement of the loop and curtain.
Figure 6:
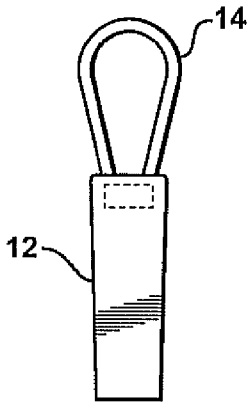
FIG. 6 is a rotated front view of the magazine with loop and curtain body.

Referring now to FIG. 4, a top diagrammatic view of the magazine retrieval sock is illustrated from one vantage point, and again showing the arrangement of the lanyard/loop 14 relative to the extending curtain body 12. FIG. 5 is a succeeding side view, again showing the arrangement of the loop and curtain. FIG. 6 is a rotated front view of the magazine, again illustrating the loop and curtain body from another vantage point.

Figure 7:
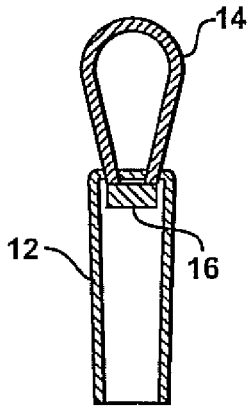
FIG. 7 is a cutaway view taken along line A-A of FIG. 4 and showing, from a front direction, the interior configuration of the loop, curtain and internal, integrally formed and floor plate engaging location associated with the retrieval sock.
Figure 8:
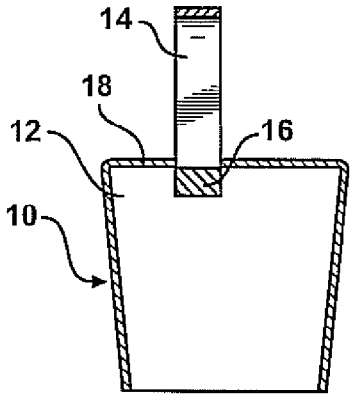
FIG. 8 is a second cutaway view taken along line B-B of FIG. 4 and showing, from a side direction, the interior configuration of the sock.

Referring now to FIG. 7, a cutaway view is taken along line A-A of FIG. 4 and shows, from a front direction, the interior configuration of the loop, curtain and internal, integrally formed and floor plate engaging location associated with the retrieval sock. FIG. 8 is a second cutaway view taken along line B-B of FIG. 4 and showing, from a side direction, the interior configuration of the sock.

Figure 9:
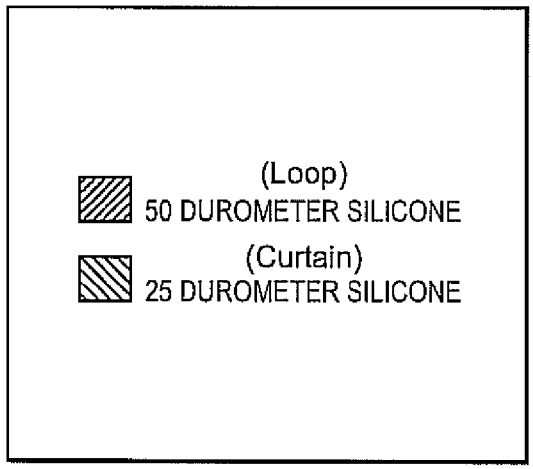
FIG. 9 is a legend of the durometer-rated silicone components associated with the loop and curtain portions of the magazine retrieval sock.

As additionally shown in FIG. 9, a legend of the durometer rated silicone components associated with the loop and curtain portions of the magazine retrieval sock references a 50 durometer silicone rating for the loop 14, with a further 25 durometer rating for the magazine surface encircling curtain 12. The looped lanyard 14 is further illustrated in slightly off center position relative to the base surface 18, however it can also be repositioned to any corner of the base surface without departing from the scope of the invention. It is also envisioned that the construction of the sock 10 can be of other materials, such as other synthetic rubberized components and/or composite cloth, synthetic fiber and other materials.

In addition to the above described, additional advantages and optional applications associated with the magazine retrieval sock include:

1. Facilitating faster magazine retrieval/disengagement, typically in silent draw fashion, and such as through the use of a single (bare or gloved) finger for which the lanyard loop is sized to ideally receive.

2. Allowing for silent retrieval of magazines from pouches or bandoliers.

3. Providing for increased serviceability and life cycle, such as following magazine drop/free fall on a hard surface.

4. Establishing a synthetic and environmentally sealing arrangement over the exposed end of the magazine, such as during transport by an individual in a prone or low crawling position and further preventing such contaminants to enter into the feeding device or magazine.

5. Sized so as not to slip off or otherwise disengage from the magazine.

6. Utilized with other projectile/firearm devices, including bb guns, pellet gun feeding devices, paintball devices, rimfire magazines, pistol caliber magazines, rifle magazines and shotguns.

7. Secured to any location associated with a magazine, not limited to an exposed and extending end.

8. Incorporating any form of convection or heat treating of the sock material (synthetic or cloth) so as to adhere to the surface or any of the feeding devices/magazine components.

Having described my invention, other and additional preferred embodiments will become apparent to those skilled in the art to which it pertains and without deviating from the scope of the appended claims.

I claim:

1. A sock adapted to being secured to an ammunition holding magazine of a projectile firing device, said sock comprising:

a flexible body exhibiting a plurality of interconnected sides with an open outer end, said body revealing a three dimensional extending interior which corresponds to a lower most extending portion of the magazine;

said body further including a base surface establishing a closed inner end and which is adapted to overlay an end surface of the magazine;

an integrally formed lanyard loop extending from said base surface and enabling single finger engagement for withdrawal of the magazine from the projectile firing device;

a projecting portion integrally formed with and extending from said base surface in a direction opposite said lanyard loop, said projecting portion adapted to being seated within a central recess associated with a magazine retaining plate which is in turn seated within an open end of the magazine; and a laterally directed opening defined within said projecting portion, such that said projecting portion is spaced a distance from said base surface, said laterally directed opening adapted to receive a floor plate of the magazine in order to secure said projecting portion between the floor plate and the magazine retaining plate.

2. The sock as described in claim 1, further comprising said sock being constructed of a silicone.

3. The sock as described in claim 1, wherein said body acts as an environmentally resistant covering.

4. The sock as described in claim 2, further comprising said loop being constructed of a 50 durometer silicone and said body being constructed of a 25 durometer silicone.

5. The sock as described in claim 1, wherein said lanyard loop extends in a off-center position relative to said base surface.

6. The sock as described in claim 1, said body exhibiting at least one of a synthetic rubber, a composite cloth, and or a synthetic fiber construction.

7. A method for applying a retrieval sock to an exposed end of an ammunition holding magazine associated with a projectile firing device, said method comprising the steps of:

providing a flexible body exhibiting a plurality of interconnected sides with an open outer end and an inner end, said body revealing a three dimensional extending interior which corresponds to a lower most extending portion of the magazine;

forming a lanyard loop to extend from said inner end of said body;

inverting said body over said loop and exposing a projecting portion integrally formed with and extending from said inner end in a direction opposite said lanyard loop; seating said projecting portion within a central recess associated with a magazine retaining plate which is in turn seated within an open end of the magazine;

sliding a floor plate through an opening defined in said projecting portion to capture and secure said projecting portion between the floor plate and magazine retaining plate; and rolling said body upward over an end region of the magazine to expose said lanyard loop.

8. The method as described in claim 7, further comprising the step of forming said body and loop from a silicone material.

9. The method as described in claim 8, further comprising the step of forming said lanyard loop to extend in a slightly off-center position relative to said inner end.

* * * * *